US011846486B2

(12) United States Patent
Caudle et al.

(10) Patent No.: US 11,846,486 B2
(45) Date of Patent: Dec. 19, 2023

(54) PNEUMATIC SEQUENTIAL INJECTION RIFLE

(71) Applicants: Carl E Caudle, Moses Lake, WA (US); Nathanel J Caudle, Moses Lake, WA (US); Nakkii White, Dalton Gardens, ID (US); Patrick D. S. Reed, Spokane, WA (US)

(72) Inventors: Carl E Caudle, Moses Lake, WA (US); Nathanel J Caudle, Moses Lake, WA (US); Nakkii White, Dalton Gardens, ID (US); Patrick D. S. Reed, Spokane, WA (US)

(73) Assignee: Modern Pneumatic Sporting Devices LLC, Dalton Gardens, ID (US)

( * ) Notice: Subject to any disclaimer, the term of this patent is extended or adjusted under 35 U.S.C. 154(b) by 121 days.

(21) Appl. No.: 17/485,348

(22) Filed: Sep. 25, 2021

(65) Prior Publication Data

US 2022/0099405 A1 Mar. 31, 2022

Related U.S. Application Data

(60) Provisional application No. 63/083,598, filed on Sep. 25, 2020.

(51) Int. Cl.
*F41B 11/723* (2013.01)
*F41B 11/62* (2013.01)

(52) U.S. Cl.
CPC ..... *F41B 11/723* (2013.01); *F41B 11/62* (2013.01)

(58) Field of Classification Search
CPC ..... F41B 11/60; F41B 11/62; F41B 11/682; F41B 11/723; F41B 11/72
USPC ..... 124/71, 59, 73, 74
See application file for complete search history.

(56) References Cited

U.S. PATENT DOCUMENTS 3,483,793 A * 12/1969 Marcus ..... B25C 1/085 89/7
3,940,981 A * 3/1976 Covey ..... F41J 13/00 73/167
4,590,842 A * 5/1986 Goldstein ..... F41B 6/00 376/125
4,678,010 A * 7/1987 Purvis ..... F15B 1/24 92/174
5,016,518 A * 5/1991 Kaplan ..... F41A 1/02 89/8
7,775,148 B1 * 8/2010 McDermott ..... F41B 11/723 89/1.809
8,056,462 B1 * 11/2011 Lacy ..... F41B 11/62 89/8
8,671,927 B1 * 3/2014 Macy ..... F41A 3/26 124/75
2003/0094167 A1 * 5/2003 Nibecker, Jr. ..... F41B 11/723 124/64
2014/0060511 A1 * 3/2014 Macy ..... F41B 11/70 124/73

* cited by examiner

*Primary Examiner* — John Cooper

(57) ABSTRACT

An air gun configured to propel a projectile without the use of combustion at a preselected velocity is provided. The air gun includes at least one first valve disposed between a chamber and a source of compressed gas, and at least one enhancement mechanism to improve the efficiency of the compressed gas to propel the projectile at a preselected velocity.

21 Claims, 8 Drawing Sheets

PNEUMATIC SEQUENTIAL INJECTION RIFLE

PRIORITY CLAIM AND CROSS-REFERENCE TO RELATED APPLICATION

This application claims the benefit under 35 U.S.C. § 119(e)(1) of U.S. Provisional Application No. 63/083,598, filed Sep. 25, 2020, which is hereby incorporated by reference in its entirety.

BACKGROUND

An air gun is a type of gun that launches projectiles pneumatically with compressed air or other compressed gases (air is already a mixture of various gases), with the gases at ambient temperatures. Such "non-firearm" guns can come in several varieties, such as pump air guns, $CO_2$ cartridge air guns, and PCP (Pre-Charged Pneumatics) air guns, which utilize a reservoir or "tank" of compressed air or gases. A PCP air gun may be an unregulated mechanical PCP, a regulated mechanical PCP, or an electronic PCP.

A conventional firearm, by contrast, generates pressurized combustion gases chemically through exothermic oxidation of combustible propellants, such as gunpowder, which generate propulsive energy by breaking molecular bonds in an explosive production of high temperature gases. In modern firearms, the combustion gases are generally formed within a cartridge comprising the projectile inserted into a casing containing the fuel. This propulsive energy is used to launch the projectile from the casing, and thus from the firearm.

Other differences between air guns and conventional firearms can be observed as differences in pressures inside the respective barrels, muzzle energies, projectile speeds, and projectile weights that can be shot, for example. A conventional rifle chambered for a 0.22 long rifle (LR) cartridge fires a 40-grain bullet at approximately 1200 ft/sec. A powerful air rifle may fire a 14.3 grain pellet with a muzzle velocity of approximately 900 ft/sec. The conventional firearm generates a muzzle energy of approximately 130 ft-lbs of energy at the muzzle whereas that of the air rifle generates only about 26 ft-lbs.

The compressed gas or air of air guns currently achieves maximum pressures of 4500-5000 psi, but these high pressures are not currently in common use. On the other hand, by comparison, the lowest pressure rifle cartridges may be black powder cartridges of yesteryear and certain rimfire cartridges. Some of these lesser firearm cartridges still generate barrel pressures of 15,000-20,000 psi, or 20,000-25,000 psi for rimfire, which is a much higher pressure level than air guns can currently achieve.

Therefore, the conventional high power air rifle is still "handicapped" in comparison to conventional firearms by low operating pressure of ⅕ that of a firearm, or lower, which is its primary limitation when being compared with firearms. This limitation can restrict the type and size of projectile that an air gun can launch, based on the mass of the projectile and the limited available energy of the air gun.

SUMMARY

Referring to FIG. 1, the operation of a typical air gun is described. The one or more propellant gases of an air gun go from high pressure to a lower pressure when propelling a projectile, but the one or more gases remain the same gases chemically. Significantly, the current pressure level in the reservoir or gas source of an air gun before a projectile is shot by the air gun (which can be upwards of 6000 psi in some cases) represents the maximum pressure that can be achieved behind a projectile in a conventional air gun, because there is no explosive combustion of gunpowder to create additional pressure (no expanding gases). Accordingly, the pressure curve for a conventional air gun is characterized by diminishing gases and low or no heat, which provide the energy for propelling a projectile from the air gun. The initial lower pressures of air guns and the diminishing pressure characteristic cause lower forces, which cause more limited bullet accelerations.

For example, it takes a certain amount of energy to push a projectile into the rifling of a rifle barrel, since the rifling often has an overall diameter that is slightly less than the outer diameter of the projectile. Much of the available energy from the high-pressure gas is used to push the projectile into the rifling, which diminishes the total energy available to generate the desired velocity for the projectile.

When the air gun is triggered, the hammer strikes the valve stem, opening the valve and quickly releasing some of the pressurized gases from the reservoir into the chamber behind the projectile. Projectile acceleration starts at zero as the compressed gas enters the chamber of the air gun until there is enough breech pressure for the projectile to move. The pressure within the chamber rises as stored compressed gases are introduced into the chamber. Pressure within the chamber quickly builds to match the gas pressure of the compressed gas reservoir (which may be onboard or remote from the air gun). The valve spring and the pressure within the reservoir combine to quickly reseat the valve, stopping the release of gas from the reservoir.

The projectile is expelled from the barrel of the air gun if sufficient pressure is present behind the projectile. The pressure of the gases within the chamber and within the barrel behind the projectile diminishes as the projectile travels down the barrel, since the volume the gas occupies increases. As the projectile moves down the length of the barrel, the compressed gas expands to fill the additional volume inside the barrel and the void created by the projectile moving down the barrel bore. The available energy to perform the work of driving a projectile diminishes as the gas expands, thus reducing the force on the projectile as it travels down the barrel. With the increase of volume, the gas cools as it loses energy and pressure, finally dropping to ambient pressure as the projectile leaves the end of the barrel.

A portion of the pressurized gas stored in the gas reservoir is released into the firing chamber when the air rifle is triggered. As an amount of the compressed gas passes into the chamber and barrel of the air rifle, the volume of gas in the reservoir tank is decreased and the gas pressure also decreases. Accordingly, less pressure and less energy is available for subsequent triggering events. After a number of shots, the gas reservoir no longer has sufficient gas pressure (e.g., stored energy) for additional shots, and is recharged to full pressure.

The disclosure herein describes multiple techniques and devices for overcoming the common deficiencies of a modern air rifle: providing and maintaining the energy to propel a projectile from the barrel of the air gun at a desired velocity. Described herein, in no certain order, are novel techniques and devices for improving air gun performance and mitigating the above mentioned short-comings.

BRIEF DESCRIPTION OF THE DRAWINGS

The detailed description is set forth with reference to the accompanying figures. The use of the same reference numbers in different figures indicates similar or identical items.

For this discussion, the devices and systems illustrated in the figures are shown as having a multiplicity of components. Various implementations of devices and/or systems, as described herein, may include fewer components and remain within the scope of the disclosure. Alternately, other implementations of devices and/or systems may include additional components, or various combinations of the described components, and remain within the scope of the disclosure. Shapes and/or dimensions shown in the illustrations of the figures are for example, and other shapes and or dimensions may be used and remain within the scope of the disclosure, unless specified otherwise.

FIG. 8A shows the action of the projectile impact pre-seater assembly in the ready position and FIG. 8B shows the assembly after triggering.

DETAILED DESCRIPTION

Overview

Figures 1A, 1B:
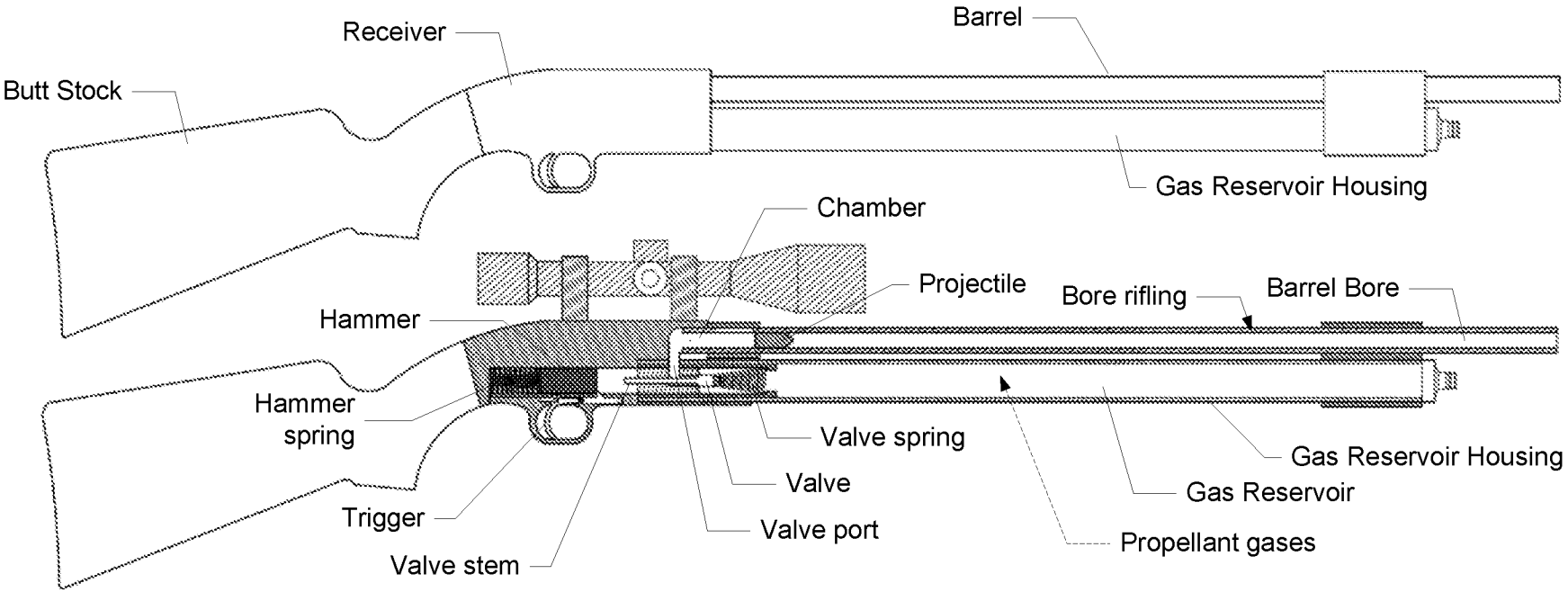
FIG. 1A shows a right side view of an example air rifle.
FIG. 1B shows a section view showing interior details of the rifle of FIG. 1A.

Representative implementations of devices and techniques provide various arrangements for the mitigation of deficient pressurized gas energy in an air rifle. In other words, the implementations provide sufficient pressurized gas energy to propel a projectile from the barrel of the air rifle at a desired velocity.

In one example, a pneumatic sequential injection technique is disclosed, with multiple embodiments that apply sequential gas injections at specified points within the air rifle. An independent valve system is also disclosed that operates with pressure changes within the barrel of the air rifle. In another example, a gas reservoir accumulator is disclosed that allows the gas pressure within the reservoir to remain more constant over a larger number of trigger events. Additionally, a projectile impact pre-seater assembly is disclosed that pre-seats the projectile within the rifling of the bore upon triggering.

Any of the disclosed devices and techniques may be used in any combination with an air rifle to increase available projectile propellant energy, improve energy consistency and efficiency over more triggering events, and provide consistent desired projectile velocities.

The primary challenge is projectile velocity, commonly measured in feet-per-second. The standard pneumatic methods used to accelerate projectiles suffer from a lack of available energy based on a single gas injection per triggering event. One solution is to incorporate multiple gas injections to each triggering event. This proposal discloses several embodiments that include multiple gas injections, with verifiable feet-per-second velocity increases. In various cases, the number of gas injections may vary, as well as the methods used to perform the multiple injections. Further, different mixtures of gasses with varying molecule sizes may be used, which can allow gas molecules to nest with each other and form a more compressed mixture, to help with expansion and heat generation.

Example Embodiments: Pneumatic Sequential Injection Air Rifles

Embodiments of multi-stage pneumatic injection systems or "Pneumatic Sequential Injection" (PSI) rifles are disclosed herein, as well as embodiments with various enhancements.

Varying amounts of energy are required to propel different sizes and masses of projectiles. Projectiles may include but are not limited to: various shapes and surfaces: Round Nose, Wad Cutter, Semi Wad Cutter, Semi-Jacketed, Full Metal Jacket, Semi-Jacketed Hollow Point, Jacketed Hollow Point, ball, or saboted, patched, or any special shape or type yet to be invented, yet to be developed; and of various compositions: Lead, Copper coated lead, Copper, Stainless Steel, Plastic, Composite, Metal or any yet to be developed single material or combination of construction materials, natural or synthetic. Compressed Gases include: air, nitrogen, helium, and/or any combination of compressible gasses known to exist.

The greatest amount of energy is needed to take a projectile from zero velocity to thousands of feet per second. The projectile must overcome the resistance of its high-coefficient of friction to the barrel bore, as the rifling is engraved into the surface of the projectile. This can be the greatest obstacle to having a consistent projectile velocity within a compressed gas propelled system.

When considering a "shot" at triggering as a single injection of compressed gas (e.g., energy), it must overcome the projectile's initial resistance and then fill the bore of the barrel. As the space needed to fill the bore increases, the pressure drops off and the energy diminishes. As the projectile moves down the bore it creates a void, an expanding volume of space behind it that must be filled while also propelling the projectile forward, so it loses its pressure and thus energy quickly, making it difficult to get consistent velocities.

Novel embodiments that deliver multiple injections of compressed gas during a single triggering event are disclosed herein. The timing of each of the multiple injections is controlled by adjustable mechanisms. The valve configurations, placement, and number of valves shown in the embodiments are for ease of description. While mechanical valves are shown in the figures, electric, electronic, or electronically operated valves may also be used in the embodiments. Additional valves in similar configurations can be added and arranged to deliver as many gas injections as desired, and at any timing and duration desired to maintain or increase the velocity of the projectile while it is within the barrel.

Generally, an initial high-velocity injection of gas is used to start the projectile down the barrel. On average the projectile moves through the barrel in 2.5 milliseconds. At a desired location within the barrel, for example at the point the leading edge of the pressure wave begins to diminish, another "shot" can be injected. Thus, this multi-valving action can occur within approximately 1.5 milliseconds of triggering. Accordingly, valve opening and closing timing can be ultra-critical and the increments ultra-minuscule. Working out the valve timing and how to mechanically achieve the end goal was not trivial or obvious and required unique innovative solutions.

First Embodiment: Multiple Consecutive In-Line Valves with Time-Adjustable Links Referring to FIGS. 2A and 2B, an embodiment is shown that delivers at least two time-adjustable injections of compressed gas when triggered. In alternate implementations, this embodiment may be used to deliver any number of gas injections during a triggering event, by adding additional valve stages in like manner as described herein.

Legend (FIGS. 2A and 2B):

A: Receiver.
B: Hammer.
C: Barrel
D: Barrel Bore.
E: Gas Reservoir(s).
F: Gas Reservoir Housing(s).
G: Secondary Valve Body.
H: Projectile.
I: Primary Valve.
J: Primary Valve Seat.
K: Primary Valve Stem.
L: Primary Valve Spring and Housing.
M: Primary Valve Port.
N: Adjustable Valve Timing/Valve Metering Gap.
O: Secondary Valve Actuation Rod, Adjustable.
P: Secondary Valve Actuation Rod Adjuster and Lock Nut.
Q: Secondary Valve.
R: Secondary Valve Seat.
S: Secondary Valve Stem.
T: Secondary Valve Spring.
U: Secondary Valve Port.
V: Barrel Gas Port.
W: Secondary Gas Port Passage Plug.

Description: Multiple Consecutive In-Line Valves with Time-Adjustable Links

Figure 2A:
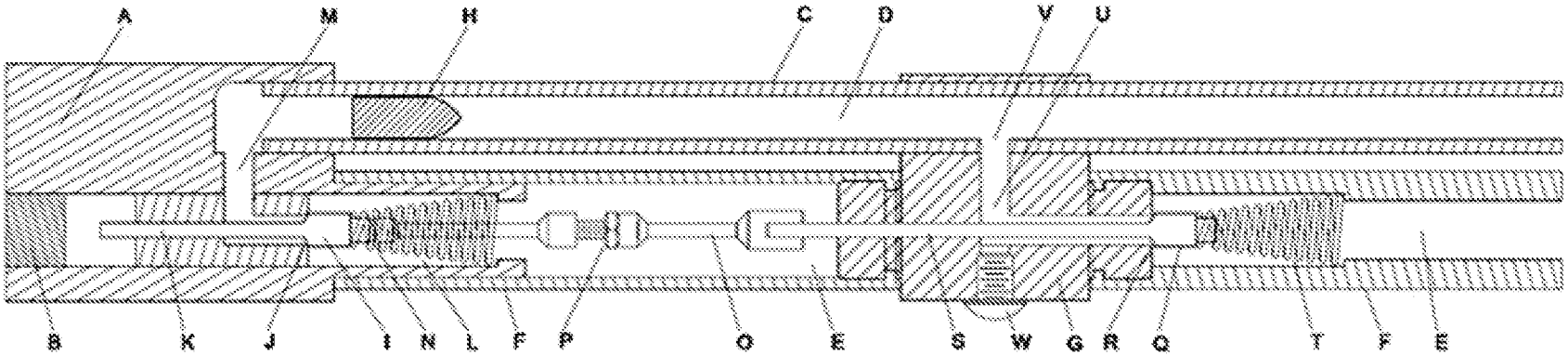
FIG. 2A shows a right side section view of an example pneumatic sequential injection rifle, showing the receiver to barrel action details, with the projectile at a first location within the barrel, according to an embodiment.
Figure 2B:
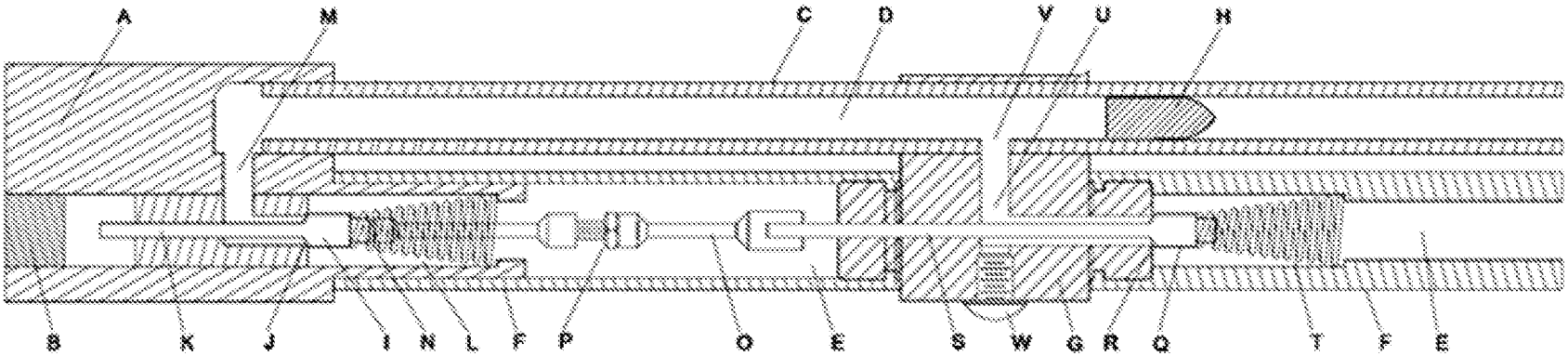
FIG. 2B shows, the projectile at a second location within the barrel, according to the embodiment.

FIGS. 2A and 2B show an example embodiment with dual valves that are arranged in line with each other, and attached (and activated) with in-line time-adjustable links. Each valve stage releases gas into the bore D according to an adjustable timing, for optimal propulsion of the projectile H. In various alternative embodiments, additional valve stages may be added and activated in a like manner as described herein.

A standard air rifle has only one valve (see FIG. 1B). This single valve can be analogous to the first valve "I" (e.g., the primary valve) of the multi-valve embodiment shown in FIGS. 2A and 2B. In the embodiment shown in FIGS. 2A and 2B, there are at least two valves, (I and Q). The arrangement works to boost the velocity of the projectile H by adding one or more additional high-pressure gas injection valve(s) Q and port(s) U further down the barrel bore from the primary valve I.

The receiver A contains the primary valve I. When the trigger mechanism is actuated, the hammer B drives forward into the primary valve stem K, initiating forward momentum of the valve stem K. The hammer B action can be initiated or entirely replaced by any mechanical, pneumatic, electrical, and/or electronic device or mechanism, or by any other future linear motion actuator.

As a result of the movement of the stem K, the primary valve I moves off its seat J and high-pressure gas from the gas reservoir E begins to flow through Primary valve Port M. High-pressure gas enters the barrel bore D behind the projectile H. The force of the pressurized gas overcomes the initial static inertia of the projectile H, forcing the projectile H to enter the high-friction rifling of the barrel bore D, and dynamically propels the projectile H forward down the barrel bore D (as shown in FIG. 2A).

As the hammer B continues its forward motion, an adjustable time-metering gap N closes between the head of the primary valve I and the secondary valve actuation rod O, accelerating the rod O forward. The secondary valve Q located in the Secondary valve housing G opens off its seat R, allowing a secondary high-pressure gas injection from the gas reservoir E to flow through the secondary valve port U, through the barrel gas port V and into the barrel bore D behind the projectile H, increasing the velocity of the projectile H (as shown at FIG. 2B).

While the first gas injection from the primary valve I initiates the forward motion of the projectile H down the barrel, the high-friction nature of the initial projectile launch expends much of the energy of the first gas injection. The second gas injection from the secondary valve Q adds energy to the forward dynamic motion of the projectile H and thus increases the forward velocity of the projectile H.

It is noted that the timing between the activation of the primary valve I and the activation of the secondary valve Q can be critical to optimizing the forward acceleration and desired velocity of the projectile H, and is fine-tuned through the secondary valve actuation rod adjuster P to insure the secondary injection occurs after the projectile H has passed the secondary barrel port V, which provides optimization of the velocity gain. The adjustment of the secondary valve actuation rod adjuster P is illustrated as a screw and nut-type of adjustment link, where turning the screw or the nut relative to the other can lengthen or shorten the actuation rod O. However, this is not intended to be limiting, and the adjustment of secondary valve actuation rod adjuster P can be made with various other types of adjustment hardware connections (e.g., replaceable rods O of different lengths, replaceable adjusters P of different lengths, rotating fittings, etc.).

As previously mentioned, additional valves can also be staged along a length of the barrel, and can be timed to deliver additional gas injections as the projectile H passes corresponding valve ports in the bore. The additional valves may be activated using additional actuation rods, as described, or using other actuation means. While mechanical valves are shown in the figures, electric, electronic, or electronically operated valves may also be used in the embodiment.

Second Embodiment: Multiple Valves Actuated Off the Hammer

Figures 3A, 3B, 3C:
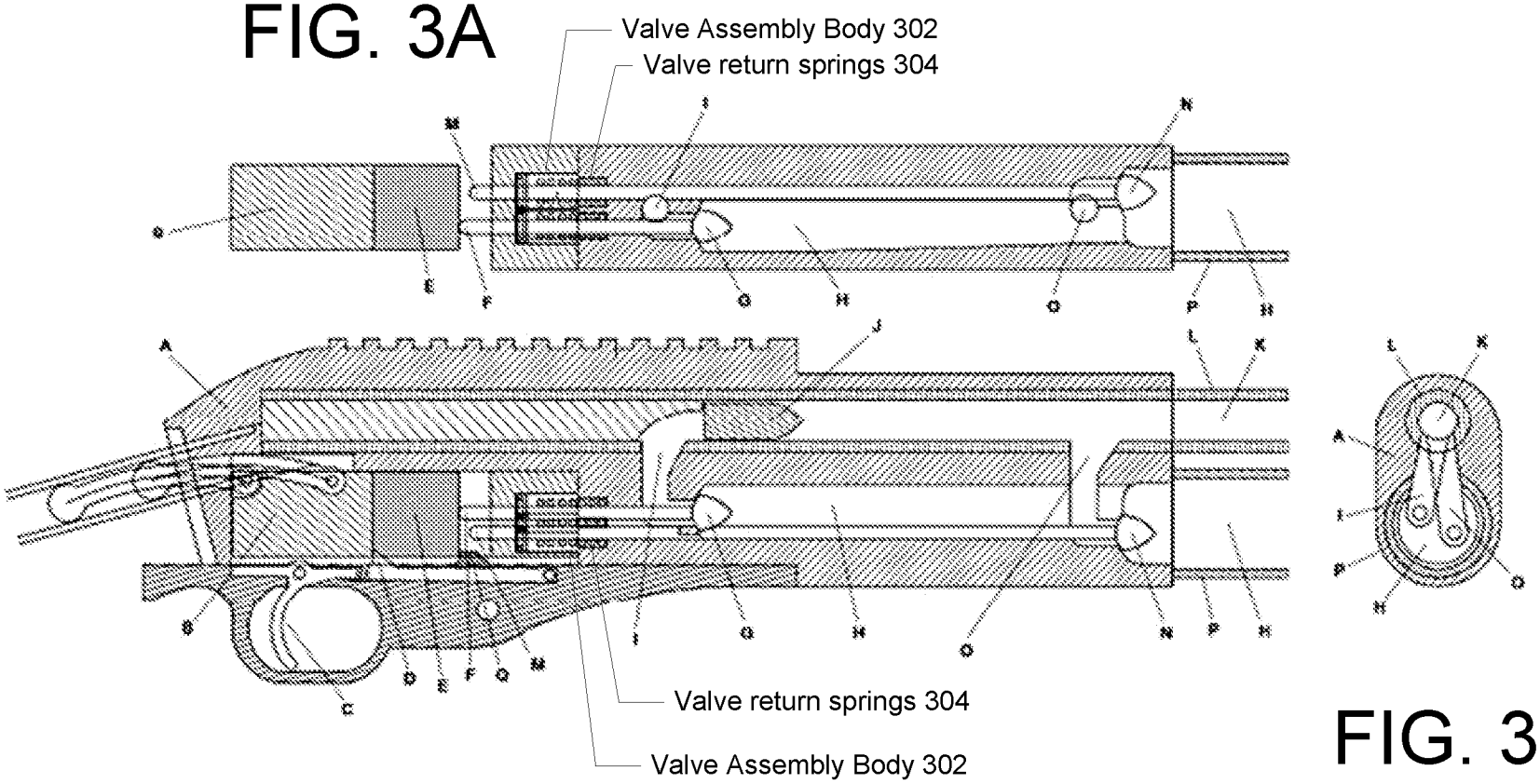
FIGS. 3A and 3B show section views of another example pneumatic sequential injection rifle, showing the receiver to barrel details, according to another embodiment.
FIG. 3C shows and end-section view of the embodiment of FIG. 3B.

Referring to FIGS. 3A-3C, another embodiment is shown that delivers at least two timed injections of compressed gas when triggered. Multiple valves may be activated by the hammer B in a timed sequence. In alternate implementations, this embodiment may be used to deliver any number of gas injections during a triggering event, by adding additional valve stages in like manner.

Legend (FIGS. 3A-3C):

A: Receiver.
B: Hammer (rear portion).
C: Trigger
D: Trigger Release
E: Hammer Head.
F: Primary valve stem.
G: Primary valve, opens first.
H: Gas Reservoir.
I: Primary port.
J: Projectile, moves down barrel bore.
K: Barrel bore.
L: Barrel.
M: Secondary valve stem contacted.
N: Secondary valve opens.
O: Secondary port.
P: Reservoir, external.
Q: Hammer Bounce Arrestor.

Description: Multiple Valves Actuated Off the Hammer

FIGS. 3A-3C show an example embodiment with dual valves that are arranged in a staggered formation with each other. The multiple valves (G and N) are each operated off the hammer head E, but at a staggered timing (which is adjustable).

As mentioned above, a standard air rifle has only one valve (see FIG. 1B). The single valve can be analogous to the first valve G (e.g., primary valve) of the multi-valve embodiment shown in FIGS. 3A-3C. In the embodiment shown in FIGS. 3A-3C there are at least two valves, (G and N). The arrangement works to boost the forward velocity of the projectile J by adding an additional high-pressure gas injection valve N and port O further down the barrel bore from the primary valve G.

Receiver A houses the valves (G and N) and/or the valve assembly body 302. When the trigger release C is pulled rearward, the hammer head E drives forward into the primary valve stem F initiating forward motion of the primary valve G. The hammer action can be initiated or entirely replaced by any mechanical, pneumatic, electrical, and/or electronic device or mechanism or by any other future linear motion actuator.

The primary valve G opens and high-pressure gas from the gas reservoir H begins to flow through the primary valve port I. High-pressure gas enters the barrel bore K behind the projectile J, expending a high percentage of its energy overcoming both the static inertia of the projectile J and the high-friction of the internal rifling of the barrel L before propelling the projectile J forward.

As the hammer head E continues its forward motion it contacts the secondary valve stem M, which moves the secondary valve N forward. The differential in valve stem length between the stem F and the stem M coordinates the timing (generally in milliseconds) of the opening of the valves G and N, which insures that the projectile J will have passed the gas port O of the second valve N, and be at a desired location to optimize the forward velocity gain.

As a result of the forward motion of the secondary valve stem M, the secondary valve N opens, allowing high-pressure gas from the gas reservoir H to flow through the secondary valve port O and into the barrel bore K behind the projectile J. The second gas injection from the secondary valve N adds energy to the forward dynamic motion of the projectile J and thus increases its velocity. While mechanical valves are shown in the figures, electric, electronic, or electronically operated valves may also be used in the embodiment.

In some embodiments, the air rifle includes a Hammer Bounce Arrestor Q. In some examples, the hammer B has freedom of movement after being driven forward in a triggering event. After the hammer head E impacts the valve stems and opens the valves, it rebounds backwards, and can then oscillate between the triggering device and the valve return springs and the gas pressure in the reservoir H. The hammer bounce arrestor Q comprises a novel device for arresting the movement of the hammer B, preventing it from bouncing back on the valve stems (F and M). This prevents any upset of the valve-to-valve seat seal. For instance, the hammer bounce arrestor Q can comprise a blocking component (such as a wedge, a block, or other obstruction) that is inserted into the travel path of the hammer B after triggering (e.g., through an opening, a slot, or the like). Once in the travel path, the hammer bounce arrestor Q prevents the hammer B from reaching the valve stems (F and M) when moving forward, until the hammer bounce arrestor Q is reset, and moved out of the travel path.

Third Embodiment: Independent Pressure-Activated Valve

Figure 4:
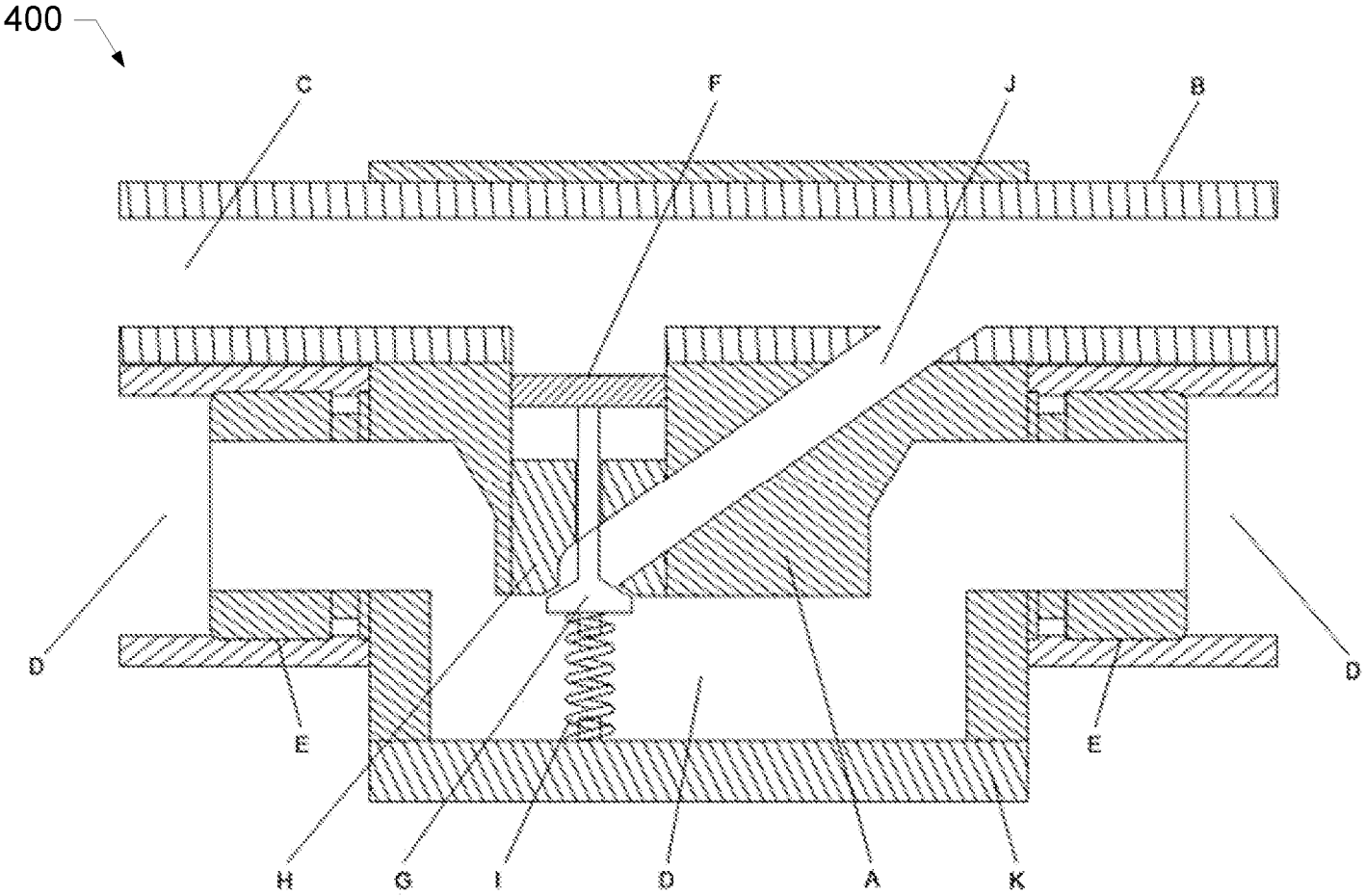
FIG. 4 shows a section view of an example independent valve assembly, according to an embodiment.
Figure 5:
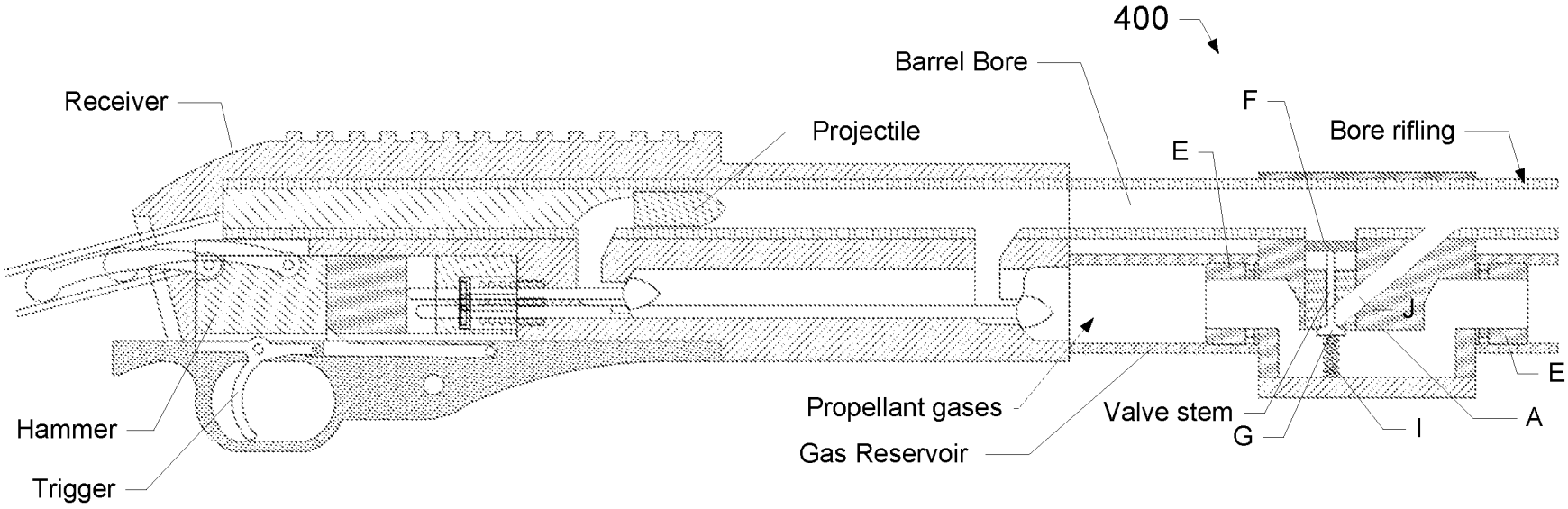
FIG. 5 shows a right side section view of an example pneumatic sequential injection rifle, incorporating an independent valve assembly, according to an embodiment.

Referring to FIGS. 4 and 5, an embodiment of a pressure-activated independent valve 400 is shown. The independent valve 400 can be used singularly or in multiples, for example, with the previously described multi-valve air rifle embodiments, or with other air rifle valve arrangements. The independent valve 400 can be used in combination with any of the embodiments disclosed herein.

Legend (FIGS. 4 and 5):

A: Valve Body.
B: Barrel.
C: Barrel Bore.
D: Gas Reservoir
E: Threaded Mounting Bosses.
F: Plunger Disk.
G: Valve.
H: Valve Seat.
I: Valve Return Spring.
J: Gas Port.
K: Valve Body Access Cover.

Description: Independent Pressure-Activated Valve

FIG. 4 shows an example embodiment of a pressure-activated independent valve 400. The valve component G is operated using the changes in pressure within the rifle bore C, using a plunger disk F to sense the pressure changes.

Standard air rifles have only one valve. This auxiliary valve 400 can give an additional high-pressure gas injection to an air rifle, and may be ganged together with other valves for multi-valve use. The arrangement works to boost the projectile's velocity by adding one or more high-pressure gas injections further down the barrel bore from the primary valve to maximize the projectile's dynamic thrust.

The drawing at FIG. 5 shows the independent valve 400 in relation to a fully pneumatic projectile launching system (e.g., air rifle). The independent valve 400 may be used in conjunction with other multi-valve systems, or with otherwise standard air rifles.

The valve body A contains a pressure differential operated valve system. As the projectile moves down the barrel bore C, and passes over the disk F, high-pressure gas trapped behind the projectile forces the disk F down against the valve return spring I, which opens the valve G.

High-pressure gas then flows through valve port J and into the barrel bore C behind the projectile. As the gas pressure within the barrel bore diminishes, the return spring I returns the disk F (and the valve G) to its closed position.

To optimize forward velocity of the projectile, the critical issue is timing, since the above action can occur within a fraction of a millisecond. The weight of the disk F, its diameter, the spring pressure/rate of the spring I, the distance between the disk F and the port opening J, and the ratio of the diameter of the disk F to the diameter of the valve G, all are influential and can be critical to the timing of the operation of the independent valve 400. Optimizing the performance of the independent valve 400 can be based on adjusting and getting the above factors optimized. As can be applied, mechanically operated valves, electric, electronic, or electronically operated valves, or valves of other types and technologies may also be used in the embodiment.

Fourth Embodiment: Gas Reservoir Accumulator

Figure 6:
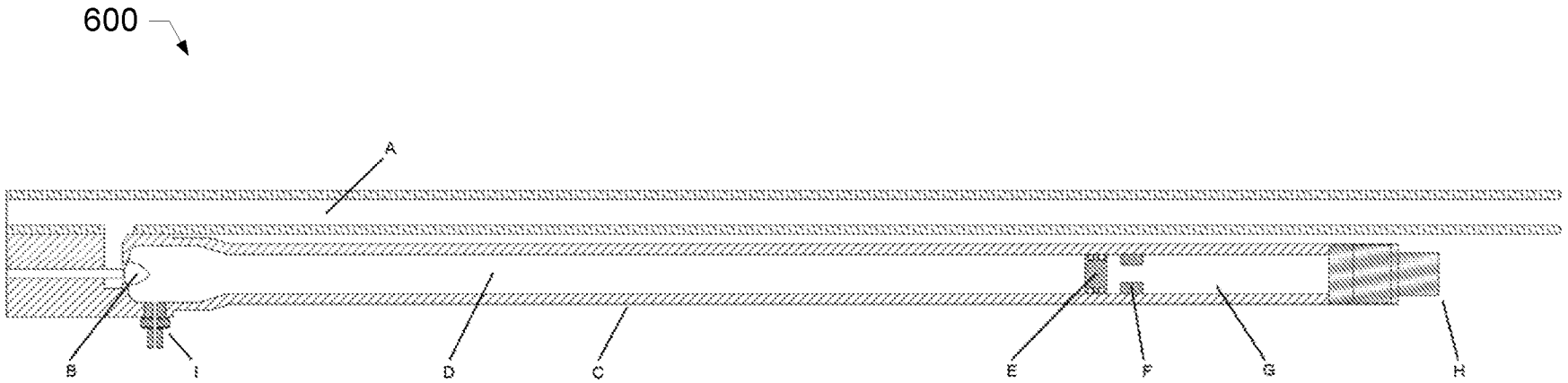
FIG. 6 shows a section view of an example gas reservoir accumulator, according to an embodiment.
Figure 7:
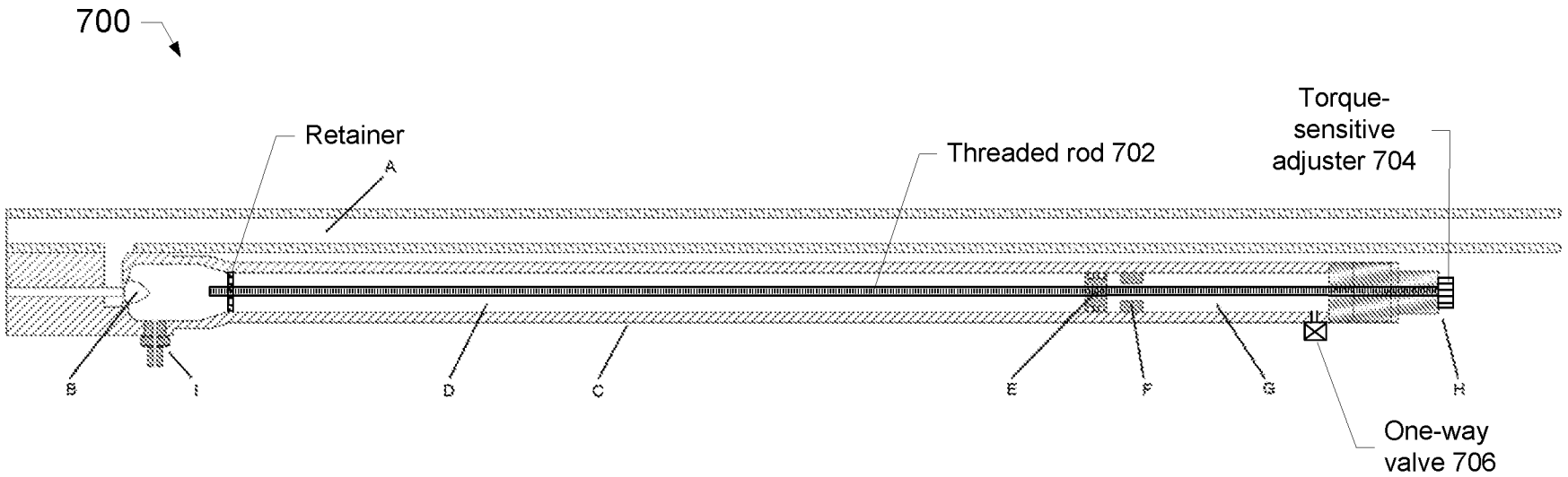
FIG. 7 shows a section view of another example gas reservoir accumulator, according to another embodiment.

Referring to FIGS. 6 and 7, various embodiments are shown that provide a higher pressure and/or more consistent injections of compressed gas when an air gun is triggered multiple times. The effective volume of the gas reservoir 600 and 700 is reduced with each shot (e.g., triggering event) thus decreasing the pressure loss in the reservoir 600 and 700 with each shot.

Legend (FIGS. 6 and 7):

A: Barrel Bore.
B: Injection Valve.
C: Gas Reservoir Tank.
D: Gas Reservoir, Low Pressure Side (discharge zone).
E: Accumulator Differential Pressure Sliding Disk.
F: Disk Stop.
G: Gas Reservoir, High Pressure Side (reserve zone).
H: High Pressure Filler with Bleeder.
I: Low Pressure Filler with Bleeder.

Description: Gas Reservoir Accumulator

FIGS. 6 and 7 show example embodiments of gas reservoir accumulators 600 and 700 that may be used with single or multi-valve air rifles. A gas reservoir accumulator 600 or 700 provides higher gas pressure and/or more consistent gas pressure over a larger quantity of shots. Metered or unmetered discharges of compressed gases ("air," nitrogen, helium, or any gas or combination of gasses) will be referred to as a "shot."

Gas pressure in an air reservoir is directly related to the volume of the gas in the reservoir relative to the volume of the reservoir. The greater the volume of gas within the fixed volume of the reservoir, the greater the pressure of the gas. Additional factors include the density of the gas composition and the temperature of the gas. The density of the gas can be controlled by the selection of the gas(es) that fill the reservoir. The temperature of the gas may be controlled by selecting the insulating characteristics of the reservoir container, and the application of heating or cooling systems or techniques to the reservoir.

When a portion of compressed gas is transitioned from the reservoir tank C into the barrel A with each shot (e.g., triggering event), the result is diminishing gas pressure in the reservoir C. With each shot the reservoir pressure decreases because the volume of the gas is reduced in the reservoir C, while the volume of the reservoir C remains constant. The remaining gas expands to fill the reservoir C, reducing the pressure of the gas. This effect can be mitigated if the volume of the reservoir C is variable instead of fixed.

The techniques and devices disclosed reduce the reservoir's effective volume with each shot, thus maintaining a greater pressure in the gas reservoir C than there would be otherwise. Reducing the volume of the gas reservoir C lessens or eliminates the diminishing pressure, thus delivering a higher more consistent gas pressure over multiple shots.

A first embodiment of a gas reservoir accumulator 600 is described with reference to FIG. 6. The gas reservoir tank C comprises a sealable tube with a constant cross-sectional diameter over most of the length of the tube. As shown in the drawing, the reservoir C can include two different pressure zones D and G, separated by a gas-impermeable disk E, which seals and separates the zones D from G. The low-pressure side, zone D is initially pressurized through valve I and the high-pressure side, zone G is pressurized through valve H.

The disk E comprises a seal that separates the two pressure zones D and G. The disk E can move freely along the length of the reservoir C, and is moved from one location to another based on the pressures on either side of the disk E. The disk E may ride on grooves, rails, or the like, along the inside wall of the reservoir C in some embodiments. Gas in the High-Pressure zone G moves the disk E away from its Disk Stop F and moves it into the Low-Pressure zone D on the discharge side, until the pressure is equal on both sides of the disk E.

With each shot, the slider disk E is pushed by the pressure within the High-Pressure Reservoir G, compressing the Low-Pressure Reservoir D, thus making each shot have a more consistent gas pressure. By way of example, each pressure zone D and G may be initially charged to 3000 psi. An example shot expends 500 psi from the low-pressure zone D. The result would be 2500 psi within the low-pressure zone D and 3000 psi within the high-pressure zone G. However, the sliding disk E is pushed toward the low-pressure zone D by the higher pressure of the high-pressure zone G, until reaching equilibrium at 2750 psi on both sides of the disk E. The 2750 psi is a higher pressure available for the next shot than the 2500 psi that would have been available without the accumulator disk E. Thus, the action of the accumulator 600 provides greater consistency of gas pressure over multiple shots.

Alternately, the "low-pressure zone" D can be initially charged to a higher pressure than the "high-pressure zone" G. For example, zone D could be charged to 3250 psi and zone G could be charged to 3000 psi. The disk E would be pushed against the disk stop F due to the unequal pressures in the zones D and G. An example shot expends 500 psi from the low-pressure zone D. The result after disk E repositioning would be 2875 psi on both sides of the disk E. The 2875 psi is a higher and more consistent pressure available for the next shot. Thus, the accumulator action provides greater consistency of gas pressure over multiple shots.

Additional components may be added to the accumulator 600 for added high-pressure shots. The example of FIG. 7 gives one possible configuration 700, of many configurations that can provide similar results. One example alternative (not shown) includes locating a spring (or similar component) behind the disk E, within zone G. The spring can add additional bias to the disk E, increasing the pressure within zone D and further reducing the diminishing effects of lost gas volume with each shot. In other examples, various mechanical components may be used to increase the pressure within zone D after each shot.

Referring to FIG. 7, another configuration 700 is shown that allows additional higher-pressure or consistent pressure shots. In the embodiment, a threaded rod 702 is disposed within the gas reservoir C, with the disk seal E threaded onto the rod 702. The discharge end of the rod 702 may be held in place and allowed to freely rotate using a retainer that allows gas to pass through it. The far end of the rod 702 is fixed to an adjuster 704, such as a rotating dial, or the like.

For instance, the dial 704 may be rotated after each shot, moving the disk E farther into the zone D, pressurizing the zone D. The dial 704 may also be on a ratcheting mechanism (or the like) for ease of use, if several rotations are needed to achieve a desired pressure in the zone D. In an embodiment, the adjuster dial 704 may also be torque-sensitive, similar to a torque wrench. The torque adjustment on the adjuster dial 704 may be set, so that when the dial 704 is rotated, it makes an indication (such as a clicking sound, for example) when the desired torque (or gas pressure) is achieved.

If zone G is pressurized, that pressure can assist the movement of the disk E in the direction of zone D after each shot, making it easier for the user to rotate the adjuster dial 704. Alternately, a one-way valve 706 may be added to the high-pressure zone G to allow air to enter zone G when the disk E is moved farther toward zone D. In that case, the zone G may not necessarily need to be manually pressurized.

In various embodiments, other mechanical components may be used to move the disk E within the reservoir C after each shot. For instance, a lever or trigger may be attached to the adjuster dial 704, where pulling the lever rotates the dial 704 (using gears, a helix, or other mechanicals, for example). In various embodiments, other mechanical components could also be used in a similar manner.

Alternately, a motor or other automating component may be added to the mechanicals to automatically move the disk E to adjust the pressure in zone D after each shot.

Fifth Embodiment: Projectile Impact Pre-Seater

Figure 8A:
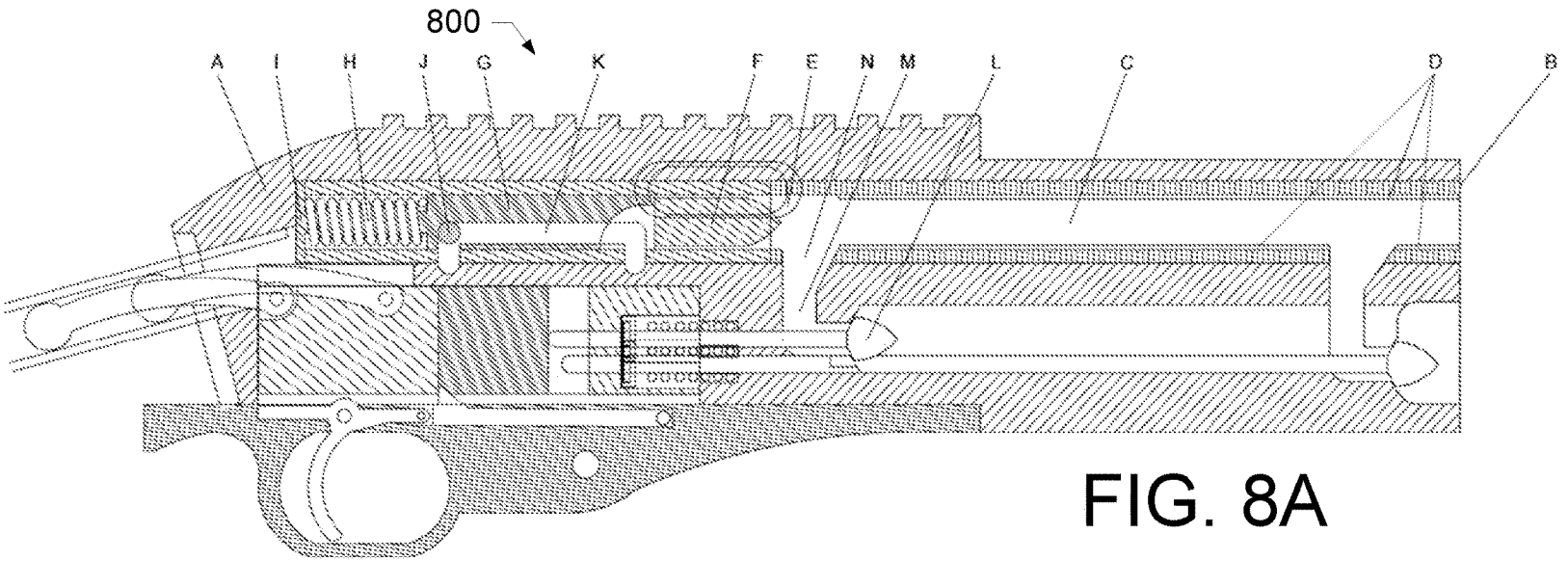
FIGS. 8A and 8B show right side section views of the receiver to barrel of an example pneumatic sequential injection rifle, including a projectile impact pre-seater assembly, according to an embodiment.
Figure 8B:
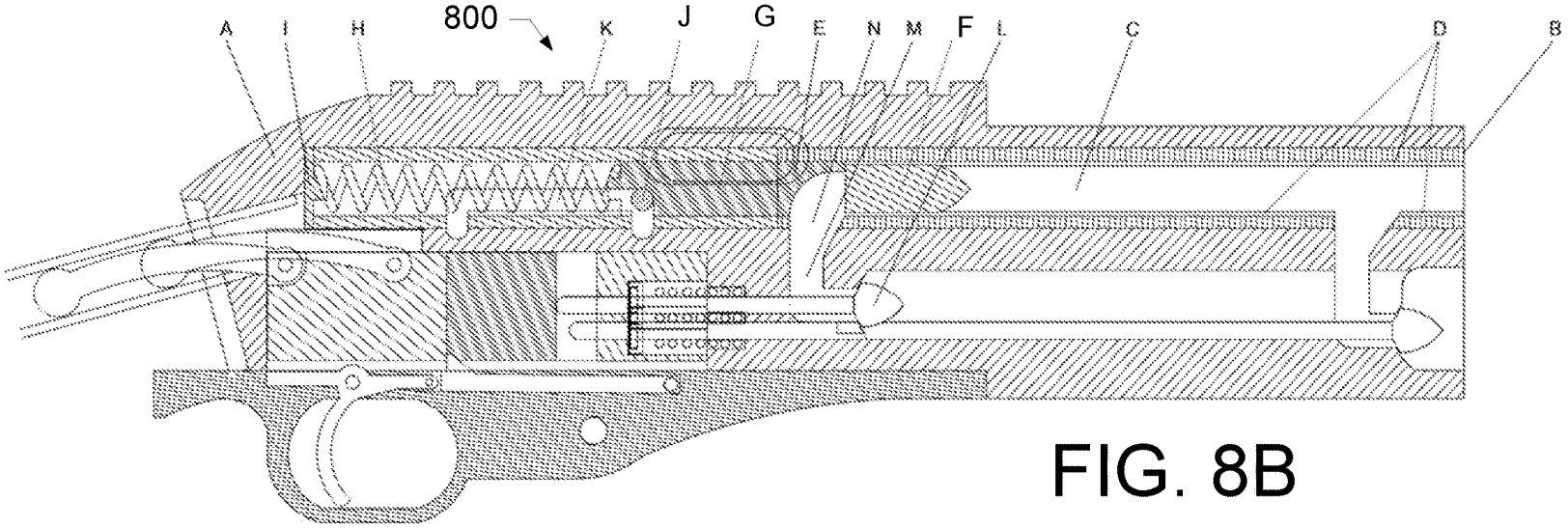

Referring to FIGS. 8A and 8B, an embodiment is shown that uses mechanical means to pre-seat a projectile F within the rifling of the bore C, and saves the pressurized gas to be used for propelling the projectile F after it is pre-seated. The views of FIGS. 8A and 8B show one example of such a mechanical pre-seating arrangement 800.

Legend (FIGS. 8A and 8B):

A: Receiver.
B: Barrel.
C: Barrel Bore.
D: Internal Rifling Land(s).
E: Projectile Loading Port
F: Projectile.
G: Pre-Seater Impact Shuttle.
H: Impact Shuttle Spring.
I: Impact Shuttle Spring Seat.
J: Control Lever.
K: Control Lever Guide Slot.
L: Primary High-Velocity Gas Valve.
M: Initial Discharge Port.
N: Barrel Discharge port.

Description: Projectile Impact Pre-Seater

FIGS. 8A and 8B show an example embodiment to overcome the massive energy requirement to start the projectile F into the barrel bore C without having to utilize the compressed gas as an initiator to begin the projectile's movement. By using a mechanical arrangement, the saved compressed gases can be used to drive the projectile F at higher velocities and with a greater degree of consistency.

A huge amount of initial energy is lost converting the static projectile F into a dynamic projectile F when the projectile F is forced into the rifling portion D of the barrel's interior. Rifling D consists of any constrictions, protrusions or shape inside the barrel's bore C intended to spin or cause the projectile's rotation, which is designed to stabilize the projectile F during flight. This process involves mechanically squeezing, engraving or broaching a shape onto the exterior of the projectile F and requires overcoming a high-coefficient of friction. Once the engraving is established over the full length of the projectile F the high-friction load stabilizes and becomes a consistent low-friction load.

This embodiment describes a mechanical arrangement 800 that pre-positions the projectile F into/through the rifling D of the bore C, providing the initial engraving over the full-length of the projectile F. Thus, the arrangement 800 eliminates the need for the pressurized gasses to expend energy to overcome the high-frictional mechanical load at the beginning of the travel down the bore C. This conserves a substantial amount of energy, and results in maximizing the energy available in the initial gas injection behind the projectile F for propelling the projectile F. The initial projectile F acceleration is more energy efficient and gives a net raise to the projectile's velocity.

The operation of the Projectile Impact Pre-Seater 800 is as follows. Referring to the drawings, in FIG. 8A, the operation begins with the Pre-Seater Impact Shuttle G in the full rearward, projectile loading position. The Impact Shuttle Spring H is fully compressed by pulling the Control Lever J attached to the shuttle G to the rear and pushing it downward into the locked position in the Control Lever Guide Slot K.

The projectile F is now ready to be inserted through the Projectile Loading Port E down into the pre-loading position pictured. The projectile F sits in front of the spring-loaded shuttle G.

Referring FIG. 8B, the Control Lever J is raised up into the long horizontal Control Lever Slot K where the Impact Shuttle Spring H is released, moving the spring H, the shuttle G, and the Projectile F forward, with the shuttle G pushing the projectile into the Barrel Bore C and fully pre-seating the Projectile F into the Rifling Land(s) D.

The Control Lever J is then lowered into its locked position ready for the Primary High-Velocity Gas Valve L to open, allowing gas to flow into the Initial Discharge Port M and through the Barrel Discharge Port N and on to the Projectile F. Note that in the embodiment shown, the contoured front surface of the shuttle G becomes part of the barrel discharge port N when in the front-locked position.

Since the Rifling Land(s) D are initially engraved into the projectile F mechanically, little to no gas energy is expended on this high coefficient of friction process, resulting in more gas energy for a faster overall Projectile F velocity.

The spring H may be selected based on the mass or caliber of the projectile intended. For instance, the strength of the spring H can be specific to the bullet used (e.g., size, materials, construction, etc.), so that the projectile F is seated fully, and without sustaining damage or being seated too far down the barrel B.

Various modifications and changes can be made to the embodiments presented herein without departing from the broader spirit and scope of the disclosure. For example, features or aspects of any of the embodiments can be applied in combination with any other of the embodiments or in place of counterpart features or aspects thereof. Accordingly, the specification and drawings are to be regarded in an illustrative rather than a restrictive sense.

While the present disclosure has been disclosed with respect to a limited number of embodiments, those skilled in the art, having the benefit of this disclosure, will appreciate numerous modifications and variations there from. It is intended that the appended claims cover such modifications and variations as fall within the true spirit and scope of the disclosure. Although various implementations and examples are discussed herein, further implementations and examples may be possible by combining the features and elements of individual implementations and examples.

CONCLUSION

Although the implementations of the disclosure have been described in language specific to structural features and/or methodological acts, it is to be understood that the implementations are not necessarily limited to the specific features or acts described. Rather, the specific features and acts are disclosed as representative forms of implementing the claims.

What is claimed is:

1. An apparatus, comprising:

an air gun configured to propel a projectile without the use of combustion at a preselected velocity, the air gun including:

a chamber of a barrel for queuing the projectile for transport into a bore of the barrel;

a bore of the barrel coupled to the chamber for expelling the projectile at the preselected velocity;

a source of compressed gas coupled to the chamber;

a trigger mechanism arranged to cause a predetermined portion of the compressed gas to enter the chamber behind the projectile to expel the projectile at the preselected velocity through the bore when activated;

at least one first valve disposed between the chamber and the source of compressed gas and arranged to open for a limited duration when the trigger mechanism is activated to introduce the predetermined portion of the compressed gas into the chamber behind the projectile; and at least one enhancement mechanism for improving the efficiency of the compressed gas to propel the projectile at the preselected velocity, wherein the at least one enhancement mechanism comprises a gas reservoir accumulator comprising a tubular gas reservoir and a moveable seal within the tubular gas reservoir capable of sliding within the length of the tubular gas reservoir and dividing the tubular gas reservoir into two separated pressure zones, one of the two separated pressure zones being a discharge zone coupled to the chamber, and including a threaded rod coupled to an adjuster mechanism, the seal being threaded onto the threaded rod, and wherein the seal is configured to move toward the discharge zone to compress gas within the discharge zone when the adjuster mechanism is activated.

2. The apparatus of claim 1, wherein the at least one enhancement mechanism further comprises at least one second valve disposed between the source of compressed gas and the bore of the barrel, the at least one second valve arranged to open for a limited duration when the projectile passes a respective predetermined point within the bore of the barrel, and to deliver compressed gas into the bore downstream of the chamber and behind the projectile.

3. The apparatus of claim 2, wherein the at least one second valve is triggered to open a predetermined time after the at least one first valve is opened.

4. The apparatus of claim 3, wherein the predetermined time is adjustable by adjusting a mechanical linkage of the at least one second valve.

5. The apparatus of claim 4, wherein the mechanical linkage couples the at least one first valve to the at least one second valve.

6. The apparatus of claim 2, wherein the at least one second valve is triggered to open by the projectile passing the respective predetermined point within the bore of the barrel.

7. The apparatus of claim 2, wherein the at least one second valve is triggered to open by a change of pressure within the bore of the barrel at the respective predetermined point within the bore of the barrel.

8. The apparatus of claim 2, wherein the at least one second valve is located colinear to the at least one first valve.

9. The apparatus of claim 2, wherein the at least one second valve is linked to the at least one first valve by an adjustable link arranged to open the at least one second valve for a preselected duration after the opening of the at least one first valve, based on a length of the adjustable link.

10. The apparatus of claim 2, wherein the at least one second valve is operated by a common hammer component to the at least one first valve and is timed to open a preset time after opening of the at least one first valve by an adjustable offset of respective valve stems of the at least one first valve and the at least one second valve.

11. The apparatus of claim 10, wherein the valve stem of the at least one first valve is parallel to the valve stem of the at least one second valve, and wherein the valve stem of the at least one first valve is positioned closer to the hammer component than the valve stem of the at least one second valve.

12. The apparatus of claim 1, wherein the at least one enhancement mechanism further comprises one or more pressure-activated valves disposed between the source of compressed gas and the bore of the barrel, each of the one or more pressure-activated valves is arranged to open when the pressure within the bore is greater than a predetermined pressure value and arranged to close when the pressure within the bore decreases to less than the predetermined pressure value.

13. The apparatus of claim 12, wherein the one or more pressure-activated valves are disposed downstream of the chamber.

14. The apparatus of claim 12, wherein the one or more pressure-activated valves are triggered to open by the projectile passing the one or more pressure-activated valves.

15. The apparatus of claim 1, wherein the moveable seal is configured to move within the tubular gas reservoir to equalize the pressure between the two separated pressure zones when gas is released from the discharge zone as a result of a triggering event.

16. The apparatus of claim 1, wherein the moveable seal is configured to move within the tubular gas reservoir to adjust the relative pressures within the two separated pressure zones.

17. The apparatus of claim 1, further including a one-way valve coupled to the tubular gas reservoir at the other of the two separated pressure zones, and configured to allow air to enter the tubular gas reservoir at the other of the two separated pressure zones when the seal is moved toward the discharge zone to compress gas within the discharge zone.

18. The apparatus of claim 1, wherein the adjuster mechanism includes a torque sensing component and wherein the pressure in the discharge zone is indicated via the torque sensing component.

19. The apparatus of claim 1, wherein the at least one enhancement mechanism further comprises a pre-seater for the projectile, comprising a spring element and a shuttle, and wherein the spring element causes the shuttle to push the projectile into the bore of the barrel at a triggering event, prior to the compressed gas entering the chamber behind the projectile to expel the projectile.

20. An apparatus, comprising:

an air gun configured to propel a projectile without the use of combustion at a preselected velocity, the air gun including:

a chamber of a barrel for queuing the projectile for transport into a bore of the barrel;

a bore of the barrel coupled to the chamber for expelling the projectile at the preselected velocity;

a source of compressed gas coupled to the chamber;

a trigger mechanism arranged to cause a predetermined portion of the compressed gas to enter the chamber behind the projectile to expel the projectile at the preselected velocity through the bore when activated;

at least one first valve disposed between the chamber and the source of compressed gas and arranged to open for a limited duration when the trigger mechanism is activated to introduce the predetermined portion of the compressed gas into the chamber behind the projectile; and at least one second valve disposed between the source of compressed gas and the bore of the barrel, the at least one second valve arranged to open for a limited duration when the projectile passes a respective predetermined point within the bore of the barrel, and to deliver compressed gas into the bore downstream of the chamber and behind the projectile, the at least one second valve being linked to the at least one first valve by an adjustable link arranged to open the at least one second valve for a preselected duration after the opening of the at least one first valve, based on a length of the adjustable link.

21. An apparatus, comprising:

an air gun configured to propel a projectile without the use of combustion at a preselected velocity, the air gun including:

a chamber of a barrel for queuing the projectile for transport into a bore of the barrel;

a bore of the barrel coupled to the chamber for expelling the projectile at the preselected velocity;

a source of compressed gas coupled to the chamber;

a trigger mechanism arranged to cause a predetermined portion of the compressed gas to enter the chamber behind the projectile to expel the projectile at the preselected velocity through the bore when activated;

at least one first valve disposed between the chamber and the source of compressed gas and arranged to open for a limited duration when the trigger mechanism is activated to introduce the predetermined portion of the compressed gas into the chamber behind the projectile; and at least one second valve disposed between the source of compressed gas and the bore of the barrel, the at least one second valve arranged to open for a limited duration when the projectile passes a respective predetermined point within the bore of the barrel, and to deliver compressed gas into the bore downstream of the chamber and behind the projectile, the at least one second valve is operated by a common hammer component to the at least one first valve and is timed to open a preset time after the at least one first valve opens based on an adjustable offset of respective valve stems of the at least one first valve and the at least one second valve.

* * * * *